US008829370B2

(12) United States Patent
Ueno

(10) Patent No.: US 8,829,370 B2
(45) Date of Patent: Sep. 9, 2014

(54) OPERATING DEVICE OF SWITCH

(75) Inventor: Hiroshi Ueno, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 371 days.

(21) Appl. No.: 13/291,404

(22) Filed: Nov. 8, 2011

(65) Prior Publication Data

US 2012/0125755 A1 May 24, 2012

(30) Foreign Application Priority Data

Nov. 24, 2010 (JP) ..... 2010-261137

(51) Int. Cl.

| | |
|---|---|
| ***H01H 19/00*** | (2006.01) |
| ***H01H 21/00*** | (2006.01) |
| ***H01H 25/04*** | (2006.01) |
| ***G05G 9/047*** | (2006.01) |

(52) U.S. Cl.

CPC ..... *H01H 25/04* (2013.01); *G05G 9/047* (2013.01); *H01H 2025/048* (2013.01)

USPC ..... 200/6 A; 200/5 R; 200/339

(58) Field of Classification Search

USPC ..... 200/6 A, 4, 335, 337, 553, 557

See application file for complete search history.

(56) References Cited

U.S. PATENT DOCUMENTS 5,468,924 A * 11/1995 Naitou et al. ..... 200/6 A

FOREIGN PATENT DOCUMENTS

JP 2004-342503 12/2004

* cited by examiner

*Primary Examiner* — Renee S Luebke
*Assistant Examiner* — Lheiren Mae A Caroc
(74) *Attorney, Agent, or Firm* — Morgan, Lewis & Bockius LLP

(57) ABSTRACT

An operating device includes click feeling generation members provided on a base plate, a pusher that elastically deforms the click feeling generation members, a pressure receiving surface provided on the pusher, a shaft that is operable to tilt to directions with respect to a standing state, and an operating part provided on the shaft and engaged with the deepest part of the pressure receiving surface. The operating part is disengaged from the deepest part of the pressure receiving surface when the shaft is operated to tilt to any of the directions. When the operating part is disengaged from the deepest part of the pressure receiving surface, the operating part of the shaft pushes the pressure receiving surface to move the pusher toward the base plate, so that all of the click feeling generation members are elastically deformed from the first states to the second states.

3 Claims, 2 Drawing Sheets

OPERATING DEVICE OF SWITCH

BACKGROUND

The present invention relates to an operating device of a switch having a shaft which is operated so as to tilt in a plurality of mutually different directions from a standing state as a normal.

An operating device of a related switch includes four click feeling generation members which are arranged on a base plate. The four click feeling generation members can be respectively elastically deformed between a first state and a second state and are arranged at equal intervals of 90° in the circumferential direction along a circular virtual line. To the four click feeling generation members respectively, pushers are fixed. The four pushers respectively serve to elastically deform the click feeling generation members from the first state to the second state. When the shaft is operated, from a standing state orthogonal to the base plate, so as to tilt to any of a first direction, a second direction different by 90° relative to the first direction, a third direction different by 180° relative to the first direction and a fourth direction different by 270° relative to the first direction, one pusher corresponding to the tilting direction of the shaft elastically deforms the one click feeling generation member from the first state to the second state. When the one click feeling generation member is elastically deformed from the first state to the second state, a click feeling is applied to the tilting operation of the shaft. [Patent Literature 1] JP-A-2004-342503

In the case of the above-described operating device of the switch, when the shaft is operated respectively to a fifth direction between the first direction and the second direction, a sixth direction between the second direction and the third direction, a seventh direction between the third direction and the fourth direction and an eighth direction between the fourth direction and the first direction, the two pushers corresponding to the tilting direction of the shaft elastically deform the click feeling generation members from the first state to the second state. Namely, when the shaft is operated to tilt in the first direction to the fourth direction respectively, the one click feeling generation member is elastically deformed. When the shaft is operated to tilt in the fifth direction to the eighth direction respectively, the two click feeling generation members are elastically deformed. Accordingly, a great difference arises in the click feeling that a user receives between the former and the latter.

SUMMARY

There is provided an operating device of a switch according to the present invention, comprising:

a plurality of click feeling generation members that are provided on a base plate, and are elastically deformable between first states and second states being different from the first states;

a pusher that is supported by the click feeling generation members respectively, and elastically deforms the click feeling generation members respectively from the first states to the second states;

a pressure receiving surface that is provided on the pusher, is recessed toward the base plate, and has a dimension of a diameter which becomes small toward a deepest part thereof which is dose to the base plate;

a shaft that is operable to tilt to a plurality of mutually different directions with respect to a standing state orthogonal to the base plate as a reference; and an operating part that is provided on the shaft, and is engaged with the deepest part of the pressure receiving surface of the pusher to maintain the shaft to the standing state, wherein the click feeling generation members are respectively in the first states during the shaft is in the standing state;

wherein the operating part of the shaft is disengaged from the deepest part of the pressure receiving surface of the pusher when the shaft is operated to tilt to any of the plurality of mutually different directions from the standing state; and wherein when the operating part of the shaft is disengaged from the deepest part of the pressure receiving surface of the pusher, the operating part of the shaft pushes the pressure receiving surface of the pusher to move the pusher toward the base plate, so that all of the click feeling generation members are elastically deformed from the first states to the second states to apply a click feeling to a tilting operation of the shaft.

Preferably, the click feeling generation members are arranged on the base plate at equal intervals in a circumferential direction along a circular virtual line having an axial line of the shaft as a center.

Preferably, the first states are natural states and the second states are elastically deformed states.

When the shaft is operated to tilt to the plurality of directions respectively from the standing state, the operating part of the shaft pushes the pressure receiving surface of the pusher to move the pusher to the base plate side. When the pusher is moved to the base plate side, the pusher pushes the plurality of click feeling generation members respectively to elastically deform the click feeling generation members to the second states from the first states. Namely, even when the shaft is operated to tilt to any of the plurality of directions, since all the plurality of click feeling generation members are elastically deformed, a user receives the mutually same click feeling.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

[First Exemplary Embodiment]

Figure 1A:
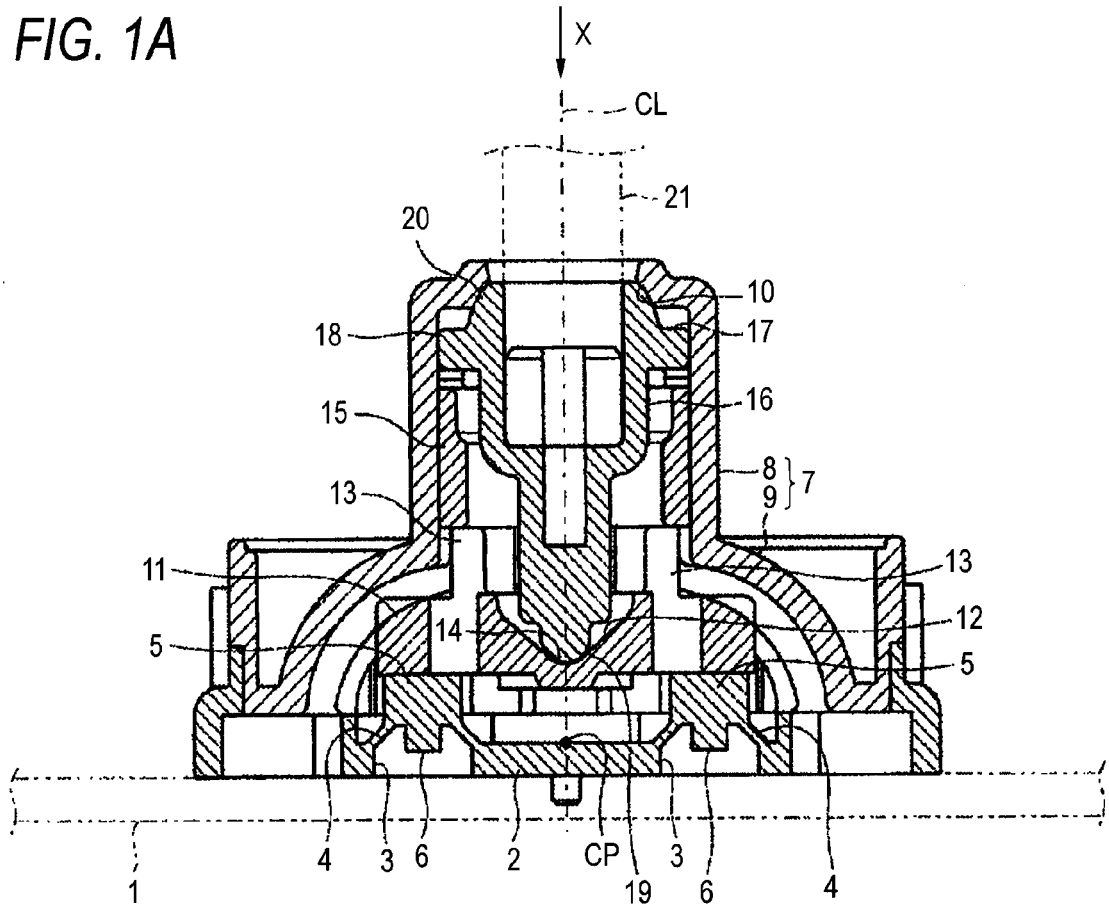
FIG. 1A is a diagram showing an inner structure of an operating device of a switch according to a first exemplary embodiment in an inoperative state of a joy stick.

A printed wiring board 1 shown in FIG. 1A corresponds to the base plate. A plate 2 made of rubber is fixed to the printed wiring board 1. The plate 2 is arranged so as to be parallel to the printed wiring board 1. Four through holes 3 are formed in the plate 2. The four through holes 3 are respectively formed in circular shapes and arranged at equal intervals in the circumferential direction along a circular virtual line having CP as a central point. Four click feeling generation parts 4 are formed in the plate 2 integrally. The four click feeling generation parts 4 respectively cover the through holes 3 from an opposite side to the printed wiring board 1 and have cylindrical shapes in which the dimensions of diameters are smaller as they go farther away from the printed wiring board 1.

As shown in FIG. 1A, click operating parts 5 are integrally formed on the four click feeling generation parts 4 of the plate 2 respectively. The click operating parts 5 are located in end parts of the four click feeling generation parts 4 opposite to the printed wiring board 1. The four click operating parts 5 are respectively formed in cylindrical shapes having dimensions of diameters smaller than those of the through holes 3. The four click feeling generation parts 4 are respectively located in natural states (neutral states) under a state that an operating force is not applied to the click operating parts 5. The four click operating parts 5 respectively stand still at initial positions separated from the printed wiring board 1 under the natural states of the click feeling generation parts 4. As shown in FIG. 2, the four click feeling generation parts 4 are bent and elastically deformed when the operating force is applied to the click operating parts 5. The four click operating parts 5 respectively enter into the through holes 3 under a state that the click feeling generation parts 4 are elastically deformed. The four click feeling generation parts 4 respectively correspond to the click feeling generation members, the natural state corresponds to the first state, and the elastically deformed state corresponds to the second state.

In the four click operating parts 5 of the plate 2 respectively, stoppers 6 are integrally formed as shown in FIG. 2. The four stoppers 6 respectively protrude toward the printed wiring board 1 side from the click operating parts 5. The four click operating parts 5 respectively stand still at limit positions moving nearer to the printed wiring board 1 side than to the initial positions due to the stoppers 6 which come into contact with the printed wiring board 1.

To the printed wiring board 1, a body 7 is fixed as shown in FIG. 1A. The body 7 is formed with a synthetic resin as a material and includes a shaft accommodating part 8 and a pusher accommodating part 9. The shaft accommodating part 8 has a cylindrical form in which one surface of the same side as the printed wiring board 1 and one surface of an opposite side thereto are respectively opened and is arranged at right angles to the printed wiring board 1 so that an axial line CL passes a central point CP. In the shaft accommodating part 8, a receiving surface 10 is formed. The receiving surface 10 is arranged in an end part of the shaft accommodating part 8 opposite to the printed wiring board 1 and has a sectional surface set to the shape of a circular arc. The pusher accommodating part 9 has a hemispherical shape having one surface of the same side as the printed wiring board 1 opened. The plate 2 is accommodated in the pusher accommodating part 9.

In the pusher accommodating part 9 of the body 7, as shown in FIG. 1A, a pusher 11 made of a synthetic resin is accommodated. The pusher 11 is supported respectively on the four click feeling generation parts 4 of the plate 2 through the click operating parts 5. In the pusher 11, one pressure receiving surface 12 and four post parts 13 are integrally formed. The pressure receiving surface 12 is recessed toward the printed wiring board 1 side and formed in a conical shape (circular cone) having the dimension of a diameter that is smaller as it comes nearer to the printed wiring board 1. The pressure receiving surface 12 is arranged so that an axial line of the pressure receiving surface 12 is overlapped on the axial line CL of the shaft accommodating part 8. In the pressure receiving surface 12, an engaging part 14 is formed. The engaging part 14 is formed in a hemispherical shape and arranged in the deepest part of the pressure receiving surface 12 nearest to the printing wiring board 1 side. The four post parts 13 respectively protrude to an opposite side to the printed wiring board 1 from the pusher 11. The four post parts 13 surround the pressure receiving surface 12 and are arranged at equal intervals in the circumferential direction along a circular virtual line having the axial line CL as a center.

In the shaft accommodating part 8 of the body 7, as shown in FIG. 1A, a push ring 15 made of a synthetic resin and a shaft 16 made of a synthetic resin are accommodated. The push ring 15 is formed integrally with the pusher 11 and arranged respectively in end parts of the four post parts 13 of the pusher 11. The push ring 15 is formed in a cylindrical shape in which one surface of the same side as the printed wiring board 1 and one surface opposite thereto are respectively opened. An outer peripheral surface of the push ring 15 is guided on an inner peripheral surface of the shaft accommodating part 8 so that the pusher 11 may be linearly moved along the axial line CL. The shaft 16 is formed in a cylindrical shape inserted into the push ring 15. In the shaft 16, a guide ring 17 is integrally formed. The guide ring 17 is formed in an annular shape protruding from an outer peripheral surface of the shaft 16. In the guide ring 17, a guide surface 18 is formed which comes into contact with the inner peripheral surface of the shaft accommodating part 8.

In the shaft 16, as shown in FIG. 1A, a pusher operating part 19 is integrally formed. The pusher operating part 19 corresponds to an operating part and is formed in a hemispherical shape protruding to the printed wiring board 1 side from the shaft 16. The pusher operating part 19 is engaged with an inner peripheral surface of the engaging part 14 of the pusher 11. The shaft 16 stands still in a standing state where an axial line of the shaft 16 is overlapped on the axial line CL by an engaging force between the pusher operating part 19 and the engaging part 14. The shaft 16 is arranged at right angles to the printed wiring board 1 under the standing state. A guide surface 20 is formed on the shaft 16, and is located in an end part opposite to the printed wiring board 1. The guide surface 20 has a sectional surface set to the shape of a circular arc and comes into a receiving surface 10 of the body 7.

As shown in FIG. 1A, to the shaft 16, a joy stick 21 is fixed. The joy stick 21 protrudes outward from an inner part of the body 7. Under an inoperative state that an operating force is not applied to the joy stick 21, the four click feeling generation parts 4 are respectively located in their natural states against a total of loads of the joy stick 21, the shaft 16, the push ring 15 and the pusher 11. Under the inoperative state of the joy stick 21, the guide surface 20 of the shaft 16 is held under a state that the guide surface 20 comes into contact with the receiving surface 10 of the body 7 by an elastic force of the four click feeling generation parts 4, and the pusher operating part 19 of the shaft 16 is held under a state that the pusher operating part 19 is engaged with the engaging part 14 by the engaging force between the pusher operating part 19 and the engaging part 14. Namely, under the inoperative state of the joy stick 12, the shaft 16 is located orthogonally to the printed wiring board 1 and stands still at a position spaced by a prescribed amount from the printed wiring board 1. The joy stick 21 is operated by the hand or finger of a user. Below described 1) and 2) respectively show behaviors when the user operates the joy stick 21.

1) Pushing Operation of the Joy Stick 21

Figure 2A:
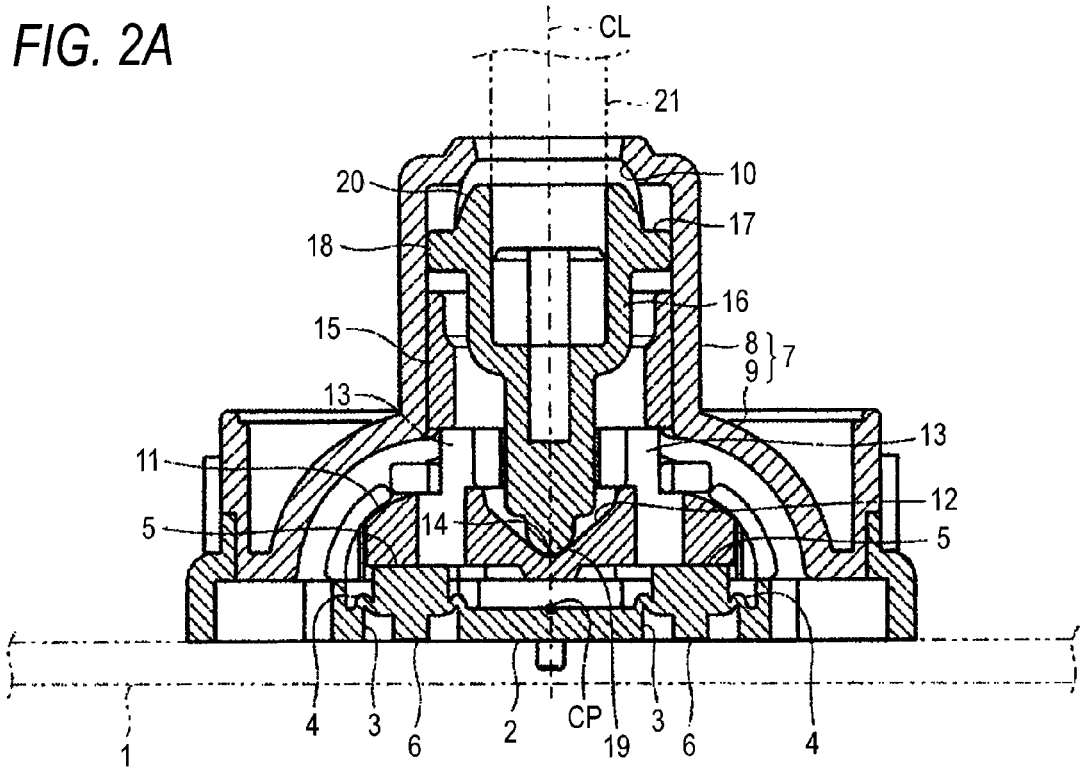
FIG. 2A is a diagram showing an inner structure of the operating device of the switch when the joy stick is pushed.

Under the inoperative state of the joy stick 21, when the user pushes the joy stick 21 toward the printed wiring board 1 side by the hand or the finger, as shown in FIG. 2A, the guide surface 18 of the guide ring 17 is guided by the inner peripheral surface of the shaft accommodating part 8 and the outer peripheral surface of the push ring 15 is guided by the inner peripheral surface of the shaft accommodating part 8 so that the shaft 16 is moved to the printed wiring board 1 side along the axial line CL. When the shaft 16 is moved to the printed wiring board 1 side, under the state that the pusher operating part 19 of the shaft 16 is engaged with the engaging part 14 of the pusher 11, the pusher operating part pushes the pusher 11 to the printed wiring board 1 side along the axial line CL. When the pusher operating part 19 of the shaft 16 pushes the pusher 11 to the printed wiring board 1 side, the pusher 11 pushes the four click operating parts 5 respectively to the printed wiring board 1 side. When the pusher 11 pushes the four click operating parts 5 respectively to the printed wiring board 1 side, the four click feeling generation parts 4 are respectively changed to the elastically deformed states from the natural states, so that the four click operating parts 5 respectively move from the initial positions to the limit positions, and the shaft 16 holds the standing state and reaches, from an initial position, to a pushed position nearer to the printed wiring board 1 side than to the initial position. Namely, the joy stick 21 is pushed against a total of the elastic force of the four click feeling generation parts 4. When the user pushes the joy stick 21, all the four click feeling generation parts 4 are changed from the natural states to the elastically deformed states, so that the user receives a click feeling.

When the user releases the hand or the finger from the joy stick 21 at the pushed position of the shaft 16, the four click feeling generation parts 4 are respectively returned from the elastically deformed states to the natural states. When the four click feeling generation parts 4 are respectively returned to the natural states, the four click operating parts 5 respectively push the pusher 11 to an opposite side to the printed wiring board 1 along the axial line CL. When the four click operating parts 5 respectively push the pusher 11 to the opposite side to the printed wring board 1, the pusher 11 pushes the shaft 16 in the standing state to the opposite side to the printed wiring board 1 along the axial line CL. When the pusher 11 pushes the shaft 16 to the opposite side to the printed wiring board 1, the guide surface 20 of the shaft 16 comes into contact with the receiving surface 7 of the body 7. Thus, the shaft 16 holds the standing state and returns to the initial position from the pushed position.

2. Tilting Operation of the Joy Stick 21

Figure 2B:
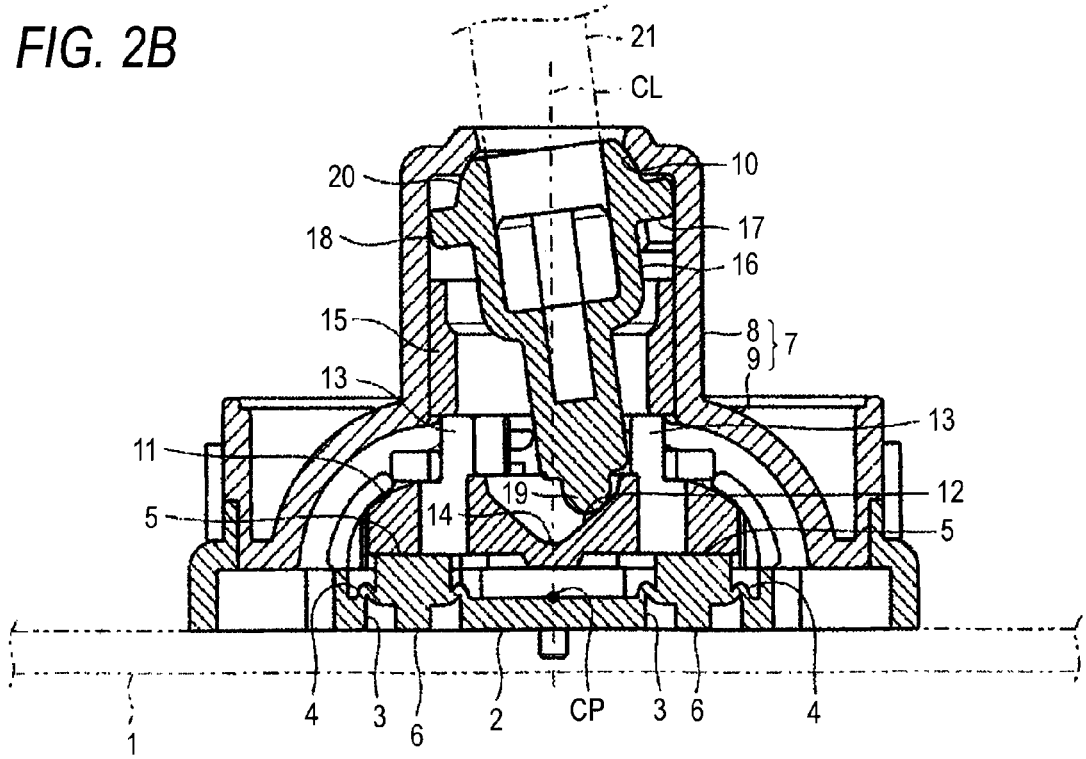
FIG. 2B is a diagram showing an inner structure of the operating device of the switch when the joy stick is operated to tilt.

Under the inoperative state of the joy stick 21, when the user tilts the joy stick 21 by the hand or the finger, as shown in FIG. 2B, the guide surface 20 of the shaft 16 is guided by the receiving surface 10 of the body 7, so that the shaft 16 is tilted in a direction intersecting the axial line CL. When the shaft 16 is tilted, the pusher operating part 19 of the shaft 16 is disengaged from the engaging part. When the pusher operating part 19 of the shaft 16 is disengaged from the engaging part 14 of the pusher 11, the pusher operating part 19 is moved in the direction more distant from the printed wiring board 1 along the pressure receiving surface 12. When the pusher operating part 19 of the shaft 16 is moved along the pressure receiving surface 12, the pusher 11 pushes the four click operating parts 5 respectively to the printed wiring board 1 side. When the pusher 11 pushes the four click operating parts 5 respectively to the printed wiring board 1 side, all of the four click feeling generation parts 4 are changed to the elastically deformed states from the natural states, so that the four click operating parts 5 are respectively moved to the limit positions from the initial positions and the shaft 16 is changed from the initial state to a tilted state where the shaft 16 is tilted relative to the axial line CL. Namely, the joy stick 21 is tilted against a total of the elastic force of the four click feeling generation parts 4. When the user operates to tilt the joy stick 21, all of the four click feeling generation parts 4 are elastically deformed from their natural states, so that the user receives a click feeling.

Figure 1B:
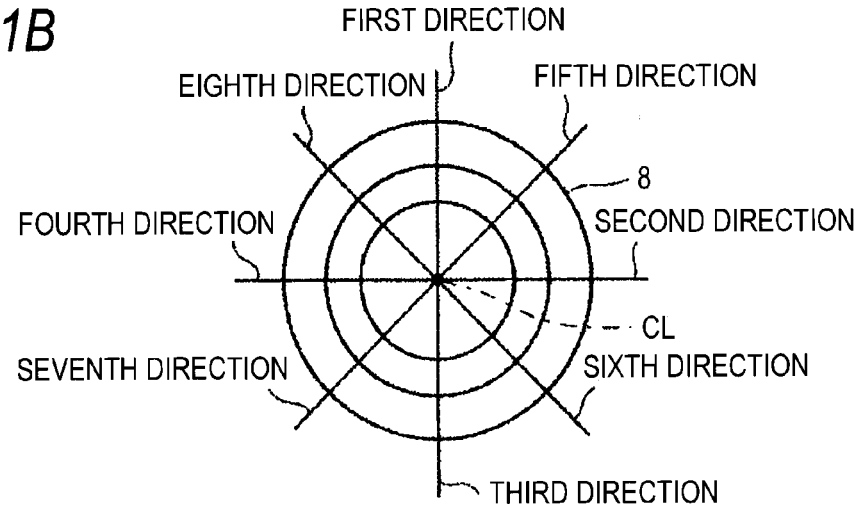
FIG. 1B is a diagram showing tilt directions of the joy stick in view from X direction.

In an operating direction when the joy stick 21 is tilted, as shown in FIG. 1B, eight directions are set which include a first direction, a second direction, a third direction, a fourth direction, a fifth direction, a sixth direction, a seventh direction and an eighth direction. The first to the eighth directions are respectively set at equal intervals in the circumferential direction. Even when the joy stick 21 is operated to tilt toward any of the first direction to the eighth direction, since the pusher 11 is moved to the printed wiring board 1 side, the four click feeling generation parts 4 are respectively changed to the elastically deformed states from the natural state. Thus, even when the user operates the joy stick 21 to be tilted toward any of the eight directions of the first direction to the eighth direction, the user can obtain the same click feeling between them.

Under a state that the joy stick 21 is tilted, when the user release the hand or the finger from the joy stick 21, the four click feeling generation parts 4 are respectively returned from the elastically deformed states to the natural states. When the four click feeling generation parts 4 are respectively returned to the natural states, the four click operating parts 5 respectively push the pusher 11 to an opposite side to the printed wiring board 1. When the four click operating parts 5 respectively push the pusher 11 to the opposite side to the printed wring board 1, an operating force is applied to the pusher operating part 19 of the shaft 16 from the pressure receiving surface 12 of the pusher 11. When the operating force is applied to the pusher operating part 19 of the shaft 16 from the pressure receiving surface 12 of the pusher 11, the guide surface 20 of the shaft 16 is guided by the receiving surface 10 of the body 7 so that the shaft 16 is moved to the standing state from the tilted state. When the shaft 16 is moved from the tilted state to the standing state, the pusher operating part 19 of the shaft 16 is engaged with the engaging part 14 of the pusher 11 so that the shaft 16 stands still in the standing state.

To the shaft 16, a switch lever is fixed. Under the inoperative state of the joy stick 21, the switch lever is opposed to a switch through a space. When the joy stick 21 is pushed from the inoperative state, the switch lever is moved to the printed wiring board 1 side from a present position to operate the switch. The switch is mounted on the printed wiring board 1 and electrically turned off under the inoperative state of the joy stick 21, and when the joy stick 21 is pushed from the inoperative state, the switch is changed to an electrically turned on state from the electrically turned off state.

In the body 7, eight levers including a first lever to an eighth lever are accommodated. The first to the eighth levers respectively stand still at inoperative positions under the inoperative state of the joy stick 21. When the joy stick 21 is operated to tilt toward the first direction from the inoperative state so that the shaft 16 is tilted to the first direction, the first lever is moved to an operative position. When the joy stick 21 is operated to tilt toward the second direction from the inoperative state so that the shaft 16 is tilted to the second direction, the second lever is moved to an operative position. When the joy stick 21 is operated to tilt toward the third direction from the inoperative state so that the shaft 16 is tilted to the third direction, the third lever is moved to an operative position. When the joy stick 21 is operated to tilt toward the fourth direction from the inoperative state so that the shaft 16 is tilted to the fourth direction, the fourth lever is moved to an operative position. When the joy stick 21 is operated to tilt toward the fifth direction from the inoperative state so that the shaft 16 is tilted to the fifth direction, the fifth lever is moved to an operative position. When the joy stick 21 is operated to tilt toward the sixth direction from the inoperative state so that the shaft 16 is tilted to the sixth direction, the sixth lever is moved to an operative position. When the joy stick 21 is operated to tilt toward the seventh direction from the inoperative state so that the shaft 16 is tilted to the seventh direction, the seventh lever is moved to an operative position. When the joy stick 21 is operated to tilt toward the eighth direction from the inoperative state so that the shaft 16 is tilted to the eighth direction, the eighth lever is moved to an operative position.

On the printed wiring board 1, eight joy stick switches including first to eighth joy stick switches are mounted. In the first joy stick switch to the eighth joy stick switch, an electric state is selectively changed depending on to which direction of the first direction to the eighth direction the joy stick 21 is operated to tilt. When the joy stick 21 is operated to tilt toward the first direction from the inoperative state, the first lever is moved to the operative position from an inoperative position to switch the electric state of the first joy stick switch. When the joy stick 21 is operated to tilt toward the second direction from the inoperative state, the second lever is moved to the operative position from an inoperative position to switch the electric state of the second joy stick switch. When the joy stick 21 is operated to tilt toward the third direction from the inoperative state, the third lever is moved to the operative position from an inoperative position to switch the electric state of the third joy stick switch. When the joy stick 21 is operated to tilt toward the fourth direction from the inoperative state, the fourth lever is moved to the operative position from an inoperative position to switch the electric state of the fourth joy stick switch. When the joy stick 21 is operated to tilt toward the fifth direction from the inoperative state, the fifth lever is moved to the operative position from an inoperative position to switch the electric state of the fifth joy stick switch. When the joy stick 21 is operated to tilt toward the sixth direction from the inoperative state, the sixth lever is moved to the operative position from an inoperative position to switch the electric state of the sixth joy stick switch. When the joy stick 21 is operated to tilt toward the seventh direction from the inoperative state, the seventh lever is moved to the operative position from an inoperative position to switch the electric state of the seventh joy stick switch. When the joy stick 21 is operated to tilt toward the eighth direction from the inoperative state, the eighth lever is moved to the operative position from an inoperative position to switch the electric state of the eighth joy stick switch.

According to the above-described first exemplary embodiment, below-described effects are obtained.

When the joy stick 21 is operated to tilt toward the first direction to the eighth direction respectively, the pusher operating part 19 of the shaft 16 pushes the pressure receiving surface 12 of the pusher 11 to move the pusher 11 to the printed wiring board 1 side. When the pusher 11 is moved to the printed wiring board 1 side, since the click feeling generation parts 4 are respectively pushed through the click operating parts 5, the click feeling generation parts 4 are deformed from the natural states to the elastically deformed states. Namely, when the joy stick 21 is operated to tilt toward the first direction to the fourth direction respectively, all the four click feeling generation parts 4 are elastically deformed. When the joy stick is similarly operated to tilt toward the fifth direction to the eighth direction respectively, since all the four click feeling generation parts 4 are also elastically deformed, the user receives the same click feeling mutually in the case of the former and in the case of the latter.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2010-261137 filed on Nov. 24, 2010, the contents of which are incorporated herein by reference.

What is claimed is:

1. An operating device of a switch comprising:

a plurality of click feeling generation members that are provided on a base plate, and are elastically deformable between first states and second states being different from the first states;

a pusher that is supported by the click feeling generation members respectively, and elastically deforms the click feeling generation members respectively from the first states to the second states;

a pressure receiving surface that is provided on the pusher, is recessed toward the base plate, and has a dimension of a diameter which becomes small toward a deepest part thereof which is close to the base plate;

a shaft that is operable to tilt to a plurality of mutually different directions with respect to a standing state orthogonal to the base plate as a reference; and an operating part that is provided on the shaft, and is engaged with the deepest part of the pressure receiving surface of the pusher to maintain the shaft to the standing state, wherein the click feeling generation members are respectively in the first states during the shaft is in the standing state;

wherein the operating part of the shaft is disengaged from the deepest part of the pressure receiving surface of the pusher when the shaft is operated to tilt to any of the plurality of mutually different directions from the standing state; and wherein when the operating part of the shaft is disengaged from the deepest part of the pressure receiving surface of the pusher, the operating part of the shaft pushes the pressure receiving surface of the pusher to move the pusher toward the base plate, so that all of the click feeling generation members are elastically deformed from the first states to the second states to apply a click feeling to a tilting operation of the shaft.

2. The operating device according to claim 1, wherein the click feeling generation members are arranged on the base plate at equal intervals in a circumferential direction along a circular virtual line having an axial line of the shaft as a center.

3. The operating device according to claim 1, wherein the first states are natural states and the second states are elastically deformed states.

* * * * *